US008061103B2

(12) United States Patent
McMahon

(10) Patent No.: US 8,061,103 B2
(45) Date of Patent: Nov. 22, 2011

(54) PANEL CONNECTOR ASSEMBLY

(76) Inventor: Barry Peter McMahon, Bolton (GB)

( * ) Notice: Subject to any disclaimer, the term of this patent is extended or adjusted under 35 U.S.C. 154(b) by 703 days.

(21) Appl. No.: 11/913,700

(22) PCT Filed: May 2, 2006

(86) PCT No.: PCT/GB2006/001585

§ 371 (c)(1),
(2), (4) Date: Nov. 6, 2007

(87) PCT Pub. No.: WO2006/120384

PCT Pub. Date: Nov. 16, 2006

(65) Prior Publication Data

US 2008/0302036 A1 Dec. 11, 2008

(30) Foreign Application Priority Data

May 7, 2005 (GB) ..... 0509385.1

(51) Int. Cl.
*E04B 1/61* (2006.01)

(52) U.S. Cl. ..... 52/582.2; 52/281; 52/584.1; 52/586.1; 52/586.2

(58) Field of Classification Search ..... 52/582.1, 52/582.2, 584.1, 586.1, 586.2, 282.3–282.5, 52/281
See application file for complete search history.

(56) References Cited

U.S. PATENT DOCUMENTS

| | | | | |
|---|---|---|---|---|
| 3,821,868 | A * | 7/1974 | Edwards | 52/282.3 |
| 5,485,704 | A * | 1/1996 | Sandor, Sr. | 52/584.1 |
| 5,491,943 | A | 2/1996 | Vondrejs et al. | |
| 5,537,795 | A * | 7/1996 | Dias | 52/586.2 |
| 5,592,794 | A | 1/1997 | Tundaun et al. | |
| 2003/0217523 | A1 | 11/2003 | Budzinski | |

FOREIGN PATENT DOCUMENTS

| | | | |
|---|---|---|---|
| DE | 10253417 | A1 | 5/2004 |
| GB | 1567161 | A | 5/1980 |

* cited by examiner

*Primary Examiner* — Robert Canfield
*Assistant Examiner* — Matt J Smith
(74) *Attorney, Agent, or Firm* — Trego, Ilines & Ladenheim, PLLC

(57) ABSTRACT

There are provided panel assemblies (2) for forming building structures. A panel assembly (2) comprises a panel (3) and a first connector means for forming part of a connector assembly (1) for connecting the panel (3) to a body (5). Said connector assembly (1) comprises said first connector means, a second connector means, one or more securement members (30) and optionally a link member (200). The connector means are arranged such that in use they can be positioned in a connecting configuration in which a channel is defined. The channel having an opening on a facing side of the panel (3) for receiving securement members (30) which can be located to restrict relative movement of the panel (3) and body (5). Also provided are kits for forming building structures, building structures and methods of assembling structures.

24 Claims, 14 Drawing Sheets

PANEL CONNECTOR ASSEMBLY

FIELD OF INVENTION

The present invention relates to panel assemblies for forming building structures, to kits for forming building structures, to building structures, particularly, though not exclusively, to glazed building structures and to methods of assembling building structures.

BACKGROUND TO THE INVENTION

It is known to construct a building structure, such as a conservatory, by locating a number of panel units adjacent one another and securing them to one another and/or to connector members and/or to a framework.

A known method of construction employs mullions as connector members to which window frames are secured by screws. In this method frames are secured to either side of a mullion by installing screws into the mullion from the inside of the window frame. It is generally then necessary to conceal the screw heads to provide an aesthetically pleasing structure. Additionally, it is often desirable to construct building structures using pre-glazed frames. However, the glazing generally requires removal in order to allow screws to be installed to secure the frame to the mullion.

Attempts have been made to address the difficulties associated with such methods. GB-A-2,397,610 for example relates to a connector which can be used to connect the frames of two adjacent window units. The connector comprises a shank with identical heads provided at its respective ends. In use the axis of the shank extends in the plane of the frames and the heads locate in channels formed in the frames edges. To secure the frames together the connector must be rotated to move the heads to an orientation in which they are held within the channels. In order to rotate the connector in this manner it is necessary to correctly locate the heads in the channel and then to insert a spanner through a gap between the frames to engage the connector. A difficulty with this arrangement is that the channels into which the connector must be located may be hidden from view as the frames are moved together. This may make assembly awkward.

Accordingly, preferred embodiments of the present invention aim to address at least one disadvantage associated with the prior art whether discussed herein or otherwise.

SUMMARY OF THE INVENTION

According to a first aspect of the present invention there is provided a panel assembly for forming a building structure, said panel assembly comprising a panel and a first connector means for forming part of a connector assembly for connecting the panel to a body, said connector assembly comprising said first connector means, a second connector means, one or more securement members and optionally a link member, wherein the first and second connector means are, or can be, connected to the panel and body respectively and, wherein the first connector means is arranged such that, in use, it can be positioned in a connecting configuration in which it engages the second connector means or engages the link member which in turn engages the second connector means, such that said first connector means and/or said panel cooperate with said second connector means and/or said link member and/or said body to define a channel having an opening on a facing side of the panel for receiving an engagement part of one or more securement members and wherein said securement members can be located to be held by said channel such that they restrict relative movement of the panel and body.

Suitably, said channel for receiving an engagement part of one or more securement members comprises a rebated channel.

As used herein, the term "facing side" means a side of a panel orientated to face inwardly, or outwardly of a building structure in use.

The opening of the channel may thus be orientated to face into or out of a building structure rather than towards a body to which said panel is to be connected. The opening of the channel may therefore be clearly visible during the construction of a building structure. It may thus be a straightforward process for a person assembling a building structure to install securement members by moving them towards a facing side of the panel and into the channel formed by the connector members.

Suitably, when located in the channel (installed), the securement member or members restrict movement of the panel relative to a body, in a facing direction. This may be achieved by restricting relative movement of the first and second connector means.

As used herein, the term "facing direction" means a direction extending away from a facing side of a panel.

Suitably, when installed, the securement member or members may restrict movement of the panel in a facing direction which comprises the direction in which the opening of the channel faces. Said facing direction may extend substantially perpendicular to the plane of the panel.

Additionally, when installed, the securement member or members may restrict movement of the panel in a facing direction substantially opposed to said facing direction in which the opening of the channel faces.

Further, when installed, the securement member or members may restrict movement of the panel in a direction transverse to a facing direction.

The panel may comprise a window frame. Suitably, the panel comprises a glazed window frame.

Suitably, the panel assembly is arranged to be connected to a body which comprises a building element or structure. Said building element may comprise a panel. Alternatively, said building element may comprise a sill.

The panel assembly may comprise a first connector means arranged to form part of a connector assembly in which the first connector means directly engages said second connector means.

Accordingly said panel assembly may comprise a panel and a first connector means for forming part of a connector assembly for connecting the panel to a body, said connector assembly comprising said first connector means, a second connector means and one or more securement members, wherein the first and second connector means are, or can be, connected to the panel and body respectively and wherein the first connector means is arranged such that, in use, it can be positioned in a connecting configuration in which it engages the second connector means, such that said first connector means and/or said panel cooperate with said second connector means and/or said body to define a channel having an opening on a facing side of the panel for receiving an engagement part of one or more securement members and wherein said securement members can be located to be held by said channel such that they restrict relative movement of the panel and body.

Alternatively, the panel assembly may comprise a first connector means arranged to form part of a connector assembly which includes a link member. The first connector means may thus be arranged to engage a link member.

Accordingly, said panel assembly may comprise a panel and a first connector means for forming part of a connector assembly for connecting the panel to a body, said connector assembly comprising said first connector means, a second connector means, one or more securement members and a link member, wherein the first and second connector means are, or can be, connected to the panel and body respectively and wherein the first connector means is arranged such that, in use, it can be positioned in a connecting configuration in which it engages the link member which in turn engages the second connector means, such that such that said first connector means and/or said panel cooperate with said second connector means and/or said link member and/or said body to define a channel having an opening on a facing side of the panel for receiving an engagement part of one or more securement members and wherein said securement members can be located to be held by said channel such that they restrict relative movement of the panel and body.

Suitably, the link member comprises an in-line connector.

Suitably, the link member is arranged to provide structural strength to a building structure which incorporates it. Thus, the panel of the panel assembly may not need to comprise internal reinforcement. Further, a body to which the panel is connected in use may not need to comprise internal reinforcement.

The panel assembly may be arranged such that it can be positioned adjacent a body and held in position relative to the body by bringing a link member into engagement with the first connector means of the panel and a second connector means of the body. Suitably, the link member may be slid into position.

Suitably, the panel assembly is arranged such that, in use, once the panel is held in position relative to the body by the link member one or more securement members can be located to fix the relative positions of the panel and body. Preferably, the link member is able to move relative to the connector means until the securement member or members are located in place. Thus, the panel may be loosely held in position relative to the body until the securement member or members are installed.

Suitably, the first connector means is arranged such that it can engage a link member such that said rebated channel can be a number of sizes. Suitably, the second connector means is also arranged such that it can engage a link member such that said rebated channel can be a number of sizes. Suitably, in use, the securement member or members can be located to force the rebated channel to tend to adopt its largest size. Thus, the panel and body may be locked in position relative to one another by said securement member or members.

With such an arrangement it may not be necessary for the link member to be a tight fit with the connector means in order to produce a rigid structure. Accordingly, greater manufacturing tolerances may be permissible for the components and the structure may require less effort to assemble.

Suitably, the assembly is arranged such that, in use, said rebated channel is defined by the panel and body.

Alternatively, the assembly may be arranged such that, in use, said rebated channel is defined by the panel and link member.

Alternatively, the rebated channel may be defined by the first and second connector means.

The first connector means may comprise a connector member which is or can be connected to the panel. Suitably, said connector member comprises an attachment portion for connecting to the panel. Alternatively, the first connector means may be provided by a part of the panel.

Suitably, the panel assembly comprises a panel having the first connector means connected to the panel or formed integrally therewith.

The second connector means of the connector assembly may comprise a connector member which is or can be connected to the body. Alternatively, the second connector means may be provided by a part of the body.

The connector assembly may comprise engagement means arranged, in use, to restrict separation of the panel and body.

The first connector means may comprise engagement means arranged, in use, to cooperate with engagement means of the second connector means and/or further engagement means of the connector assembly to restrict movement of the first connector means relative to the second connector means, from a connecting configuration, and thus restrict separation of the panel and body.

Said engagement means of the first connector means may be arranged to directly engage said engagement means of the second connector means.

Alternatively, said engagement means of the first connector means may be arranged to engage a further engagement means which in turn engages said engagement means of the second connector means. Suitably, said further engagement means may be provided by a link member.

The engagement means of the connector assembly may be arranged to restrict movement of the panel and body relative to one another in a direction transverse to a facing direction. The engagement means may be arranged to restrict movement of the panel and body relative to one another in a direction extending generally in the plane of the panel.

Said engagement means of the connector means may be arranged to limit movement of the first connector means relative to the second connector means, from said connecting configuration, in a facing direction.

The panel may comprise a first facing side which comprises an interior, in use, side of a panel. A first facing direction may extend towards the interior of a building. Suitably, the panel comprises a second facing side which comprises an external, in use, side of a panel. A second facing direction may extend towards the exterior of a building.

Suitably, the securement members or members, when installed, are arranged to restrict the first connector means from being moved in a first facing direction relative to the second connector means.

Suitably, the securement members or members, when installed, are arranged to restrict the first connector means from being moved in a second facing direction relative to the second connector means.

Suitably, in use, one or more securement members can be located in place by being moved in said second facing direction towards the second, and preferably the first, connector means.

Alternatively, or additionally, in use, one or more securement members may be located in place by being moved in said first facing direction towards the first, and preferably the second, connector means.

The first and second connector means may each comprise a jaw portion and the connector means may be arranged such that when in said connecting configuration the jaw portions cooperate to define said rebated channel.

Alternatively, the panel and body may each comprise a jaw portion and may be arranged such that when the connector means are in a connecting configuration the jaw portions cooperate to define said rebated channel.

Alternatively, the panel and a connector means may each comprise a jaw portion and may be arranged such that when the connector means are in a connecting configuration the jaw portions cooperate to define said rebated channel.

Suitably, the securement member or members comprise an engagement portion for locating in said rebated channel in use. Said engagement portion may comprise the entirety of the securement member.

Suitably, each securement member is arranged such that, in use, it can be arranged in a first orientation in which it does not restrict relative movement of the panel and body and in a second orientation in which it restricts relative movement of the panel and body.

Suitably, in said second orientation the securement member restricts relative movement of the connector means and in the first orientation it does not.

Suitably, in use, the securement member is rotatable is between said first and second orientations.

Suitably the engagement portion of the securement member is wider in a primary direction transverse to the members axis of rotation than it is in a secondary direction transverse to the members axis of rotation and which is at an angle to said primary direction.

Suitably, the securement member comprises orientation means by which its orientation may be altered in use. Suitably, the orientation means comprises an axially extending keyed cavity, for example a cavity arranged to receive an allen key.

Suitably, in use, the securement member is held in its second orientation within the channel by means of an interference fit.

Suitably, the securement member is such that an engagement portion thereof can be located between outer lips of a jaw formed by the connector means and/or panel and/or body and/or link member when the securement member is in the first orientation.

Suitably, the securement member is such that an engagement portion thereof can not fit between the outer lips when in the second orientation and can thus be retained in position. The securement member may thus restrict relative movement of the panel and body when the securement member is in the second orientation and the first connector means is in a connecting configuration.

Suitably, the securement member or members are arranged to restrict movement of the first connector means relative to the second connector means in a first facing direction when said securement member is in the second orientation. Suitably, said movement is substantially prevented.

The securement member or members may additionally be arranged to restrict movement of the first connector means relative to the second connector means in the second facing direction when said securement member is in the second orientation. Suitably, said movement is substantially prevented.

The securement member or members may further be arranged to restrict movement of the first connector means relative to the second connector means in a direction transverse to said first facing direction when said securement member is in the second orientation. Suitably, said movement is substantially prevented.

Suitably, the first and second connector means each comprise locating means for defining the connecting configuration thereof. Engagement means of the connector means may comprise the locating means. The locating means may be arranged to limit relative movement of the connector means in a facing direction.

The engagement means may comprise legs of the connector means arranged such that a leg of the first connector means engages a leg of the second connector means when the connector means are in the connecting configuration.

Alternatively, or in addition, the engagement means may comprise legs of the connector means arranged such that a leg of the first connector means and a leg of the second connector means can each be engaged by a sleeve when in the connecting configuration to restrict separation thereof. Said sleeve may thus provide said further engagement means of the connector assembly. Said sleeve may comprise part of the securement member. Alternatively, said sleeve and securement member may comprise separate components. In use, the sleeve may retain the connector means in position relative to one another and the securement member may retain the sleeve in position relative to the connector means.

Alternatively, the engagement means may comprise legs of the connector means arranged such that a leg of the first connector means and a leg of the second connector means can each be engaged by a link member when in the connecting configuration to restrict separation thereof. Suitably, said link member comprises legs for engaging the legs of the connector means. The link member may thus provide further engagement means of the connector assembly.

Suitably, the engagement means and/or locating means limit the movement of the first connector means relative to the second connector means in said facing direction such that it defines their positions for the connecting configuration.

In use, the connector means may be slid together to provide the connecting configuration and may be separated by being slid apart. Alternatively, the connector means may be located adjacent one another and a link member slid into position relative thereto to connect said connector means together.

Suitably, in use, the engagement means help to hold the connector means and thus the panel assembly in position while a securement member or members are located in place.

The locating means may, in use, help to hold the connector means and thus the panel assembly in position while a securement member or members are located in place.

The connector assembly may comprise two rebated channels one on each of opposed facing sides of the panel and each arranged to engage one or more securement members.

The first connector means and/or panel may comprise two jaw portions with co-operate with jaw portions provided by a second connector means and/or body and/or link member to define two rebated channels each of which can engage one or more securement members.

Thus, in use, securement members may be installed from an inner and/or outer side of a building structure, or partial structure, once the first connector means is positioned in a connecting configuration for connecting the panel to a body.

The first and second connector means may each comprise two or more sets of engagement means, preferably two sets.

The first and second connector means may be of substantially the same construction.

The panel assembly may comprise connector means of two or more connector assemblies. The panel assembly may comprise first connector means of two connector assemblies.

Suitably a first connector means is located on an upwardly extending, in use, edge of the panel. Suitably, a first connector means is located on a lower, in use, edge of the panel.

Preferably, first connector means are located on both said upwardly extending edge and said lower edge of the panel. In use, said first connector means may be simultaneously moved into a connecting configuration with second connector means which are connected to a body or bodies to which the panel assembly is to be secured.

The panel assembly may comprise a first connector means located on a first upwardly extending, in use, edge of the panel and a second connector means located on a second, opposed, upwardly extending, in use, edge of the panel. Thus, in use, once a panel assembly is installed it may provide a body having a second connector means to which a like panel assembly may be secured.

Preferred embodiments of the invention may have the advantage that it is unnecessary to pre-place securement members before bringing bodies which are to be connected into position adjacent one another. This may simplify the positioning of the bodies. Additionally, the securement members may be easily accessed to manipulate them into an orientation in which they restrict relative movement of the connector means.

According to a second aspect of the present invention there is provided a kit for forming a building structure, said kit comprising one or more bodies comprising building elements, including one or more panels, and one or more connector assemblies, wherein one or more connector assemblies of the kit comprises first and second connector means, one or more securement members and optionally one or more link members, wherein the first and second connector means are or can be connected to bodies which are to be connected and can be positioned in a connecting configuration in which the first connector means engages the second connector means or engages the link member which in turn engages the second connector means, such that said first connector means and/or said panel cooperate with said second connector means and/or said link member and/or said body to define a channel having an opening on a facing side of the panel for receiving an engagement part of one or more securement members and wherein said securement members can be located to be held by said channel such that they restrict relative movement of the bodies.

Suitably, said channel for receiving an engagement part of one or more securement members comprises a rebated channel.

Suitably, the kit comprises one or more link members. The kit may thus comprise first and second connector means each arranged to engage a link member.

Alternatively, the kit may comprise first and second connector means arranged to directly engage one another.

Said bodies to which the first and second connector means of a connecter assembly are connected to may comprise a building structure and a building element or two building elements, which suitably include at least one panel.

Suitably, the kit comprises one or more panel assemblies according to the first aspect.

One or more connector assemblies of the kit may be as described in relation to the first aspect.

Suitably, the kit comprises a plurality of building elements and connector assemblies. Suitably, the kit comprises a plurality of panels.

Suitably, said one or more panels comprise one or more window frames. Preferably, said window frames are glazed.

Suitably, one or more panels comprises a connector means arranged to extend along a lower, in use, edge thereof. Suitably, one or more panels comprises a connector means arranged to extend along a first, in use, upwardly extending edge thereof and preferably a connector means arranged to extend along a second, in use, upwardly extending edge thereof.

The kit may further comprise assembly instructions. The instructions may be intended to allow assembly of a building structure by an unskilled operator. The kit may thus be a "home assembly" kit.

According to a third aspect of the present invention there is provided a building structure comprising one or more panel assemblies according to the first aspect.

Suitably, the building structure is formed from a kit according to the second aspect.

Suitably, the building structure comprises one or more connector assemblies arranged to extend substantially vertically.

Suitably, the building structure comprises one or more connector assemblies arranged to extend substantially horizontally.

According to a fourth aspect of the present invention there is provided a method of assembling a building structure, wherein the method comprises locating a panel assembly comprising a panel and a first connector means adjacent a building element or structure comprising a second connector means and locating the connector means in a connecting configuration, optionally using a link member, and locating one or more securement members such that they retain the panel in position relative to the building element or structure, wherein said securement member or members, or a part thereof, are located into a channel having an opening on a facing side of the panel.

Suitably, said channel for receiving one or more securement members or a part thereof comprises a rebated channel.

Suitably, said method comprises locating a panel such that the connector means, and optionally a link member, hold the panel in position relative to a building element or structure such that it has some freedom to move until said securement member or members are installed. Suitably, once said securement member or members are installed the freedom of the panel to move is substantially removed. Thus, a rigid structure may be produced.

Preferably, the method employs a panel assembly according to the first aspect.

The method may comprise bringing engagement means of the connector means into contact as the connector means are located into the connecting configuration.

Alternatively, the method may comprise bringing a link member into position when the connector means are located adjacent one another such that the link member engages engagement means of the connector means to provide said connecting configuration.

Suitably, the method comprises locating one or more securement members into position from the inside and/or outside of a building structure, or partial structure, with the connector means located in a connecting configuration.

Suitably, the method comprises inserting an engagement portion of one or more securement members into a rebated channel defined by the connector means.

Alternatively, the method may comprise inserting an engagement portion of one or more securement members into a rebated channel defined by the panel and a building element.

Alternatively, the method may comprise inserting an engagement portion of one or more securement members into a rebated channel defined by the panel and a link member.

Suitably, following insertion of the engagement portion of a securement member the method comprises rotating the securement member relative to the connector means to orientate the securement member such that it can not be withdrawn from the channel. Suitably, this may be performed without special tools.

The method may comprise locating a panel assembly comprising a substantially horizontally extending connector means and a substantially vertically extending connector means relative to a building structure or partial structure comprising a substantially horizontally extending connector means and a substantially vertically extending connector means such that the respective connector means are located in a connecting configuration substantially simultaneously.

Suitably, the method employs a kit according to the second aspect.

Suitably, the building structure comprises a building structure according to the third aspect.

BRIEF DESCRIPTION OF THE DRAWINGS

The present invention will now be illustrated, by way of example with reference to the accompanying drawings in which.

DESCRIPTION OF THE PREFERRED EMBODIMENTS

Figure 1:
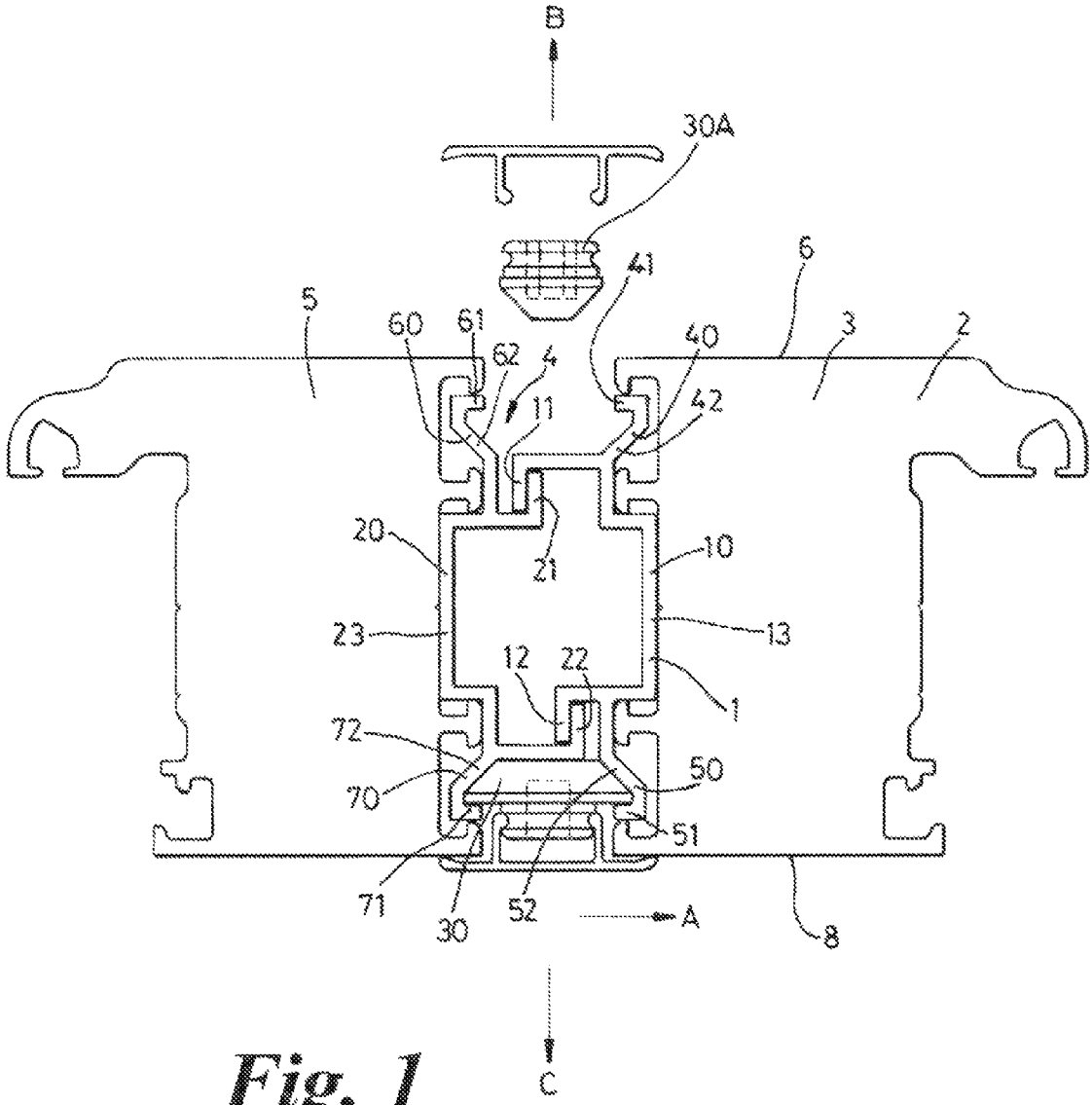
FIG. 1 is a plan view of a connector assembly joining a panel and body.

FIG. 1 illustrates a panel assembly 2, comprising a panel 3 and first connector means comprising a connector member 10, connected to a building element (body) 5 by a connector assembly 1 of which the connector member 10 forms a part.

The connector assembly 1 for connecting the panel 3 to a building element (body) 5 comprises a first connector means, comprising a connector member 10, and a second connector means, comprising a connector member 20, as well as securement members 30. Each connector member comprises an attachment portion 13, 23 by which it can be secured to a panel 3 or building 5 respectively.

The connector members cooperate to define a rebated channel 4 on a first (interior) facing side 6 of the panel 3 and a rebated channel (shown occupied by securement member 30) on an opposed (exterior) facing side 8 of the panel 3. The opening of the channel on the first facing side is orientated to face in a first facing direction (illustrated by arrow B) and that of the channel on the second facing side is orientated to face in a second, opposed, facing direction (illustrated by arrow C).

The assembly 1 comprises engagement means which restrict movement of the first connector member 10 relative to the second connector member 20 in a direction transverse to said facing directions (illustrated by arrow A) when the connector members 10, 20 are in a connecting configuration (shown by FIG. 1). The engagement means comprises part of the first and second connector members 10, 20. In the embodiment illustrated by FIG. 1 the connector members comprise two sets of engagement means. The engagement means of the first connector member 10 comprises first and second legs 11, 12 for engaging first and second legs 21, 22 respectively of the engagement means of the second connector member 20.

The connector members 10,20 are arranged such that the first connector member 10 can be moved relative to the second connector member 20 in the second facing direction (illustrated by arrow C) in order to bring the connector members 10, 20 into the connecting configuration. The extent of relative movement in the second facing direction is limited by the legs 11, 12, 21, 22 of the connector members which abut one another to act as limiting means of the assembly to define the connecting configuration.

The first connector member 10 comprises first and second jaw portions 40, 50 and the second connector member 20 comprises first and second jaw portions 60, 70. The respective first and second jaw portions 40, 60, 50, 70 cooperative to provide said rebated channels 4 in which securement members 30 can be engaged. Each jaw portion 40, 50, 60, 70 comprises an outer lip 41, 51, 61, 71 and an inner lip 42, 52, 62, 72.

Figure 1A:
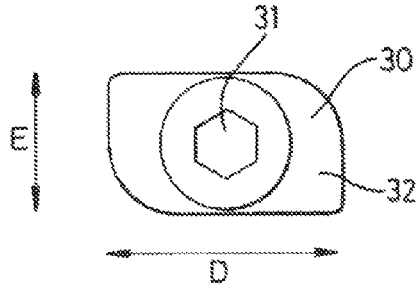
FIG. 1*a* is an end view of a securement member for connecting a panel to a body.

As illustrated by FIG. 1A the securement member 30 comprises a keyed cavity 31 extending along an axis of rotation by which the securement member 30 can be rotated in use. The securement member 30 comprises an engagement portion 32 which has a greater diameter in a primary direction (illustrated by arrow D) than in a secondary, transverse (for example perpendicular) direction (illustrated by arrow E).

In use, the engagement portion 32 of a securement member can be inserted into a channel between outer lips 41, 61 (or 51, 71) when in a first orientation (illustrated by 30A). The securement member can then be rotated such it is moved to a second orientation (illustrated by 30B) in which it cannot pass between outer lips 51, 71 (or 41, 61) and is thus retained in place. In this orientation the securement member 30 engages both outer lips 51, 71 (or 41, 61) and inner lips 52, 72 (or 42, 62).

Once installed in the second orientation the securement member 30 thus substantially prevents the first connector member 10 being moved relative to the second connector member 20 in a first facing direction (illustrated by arrow B). The securement member also substantially prevents movement in the second facing direction (illustrated by arrow C) opposed to the first facing direction.

The inner lips 42, 62, 52, 72, include parts of legs 11, 12, 21, 22 of the engagement means of the connector members 10, 20 which are arranged to prevent the securement members 30 from being moved past the inner lips when in either orientation. Thus, in use, the securement members may be readily positioned correctly.

Figure 2:
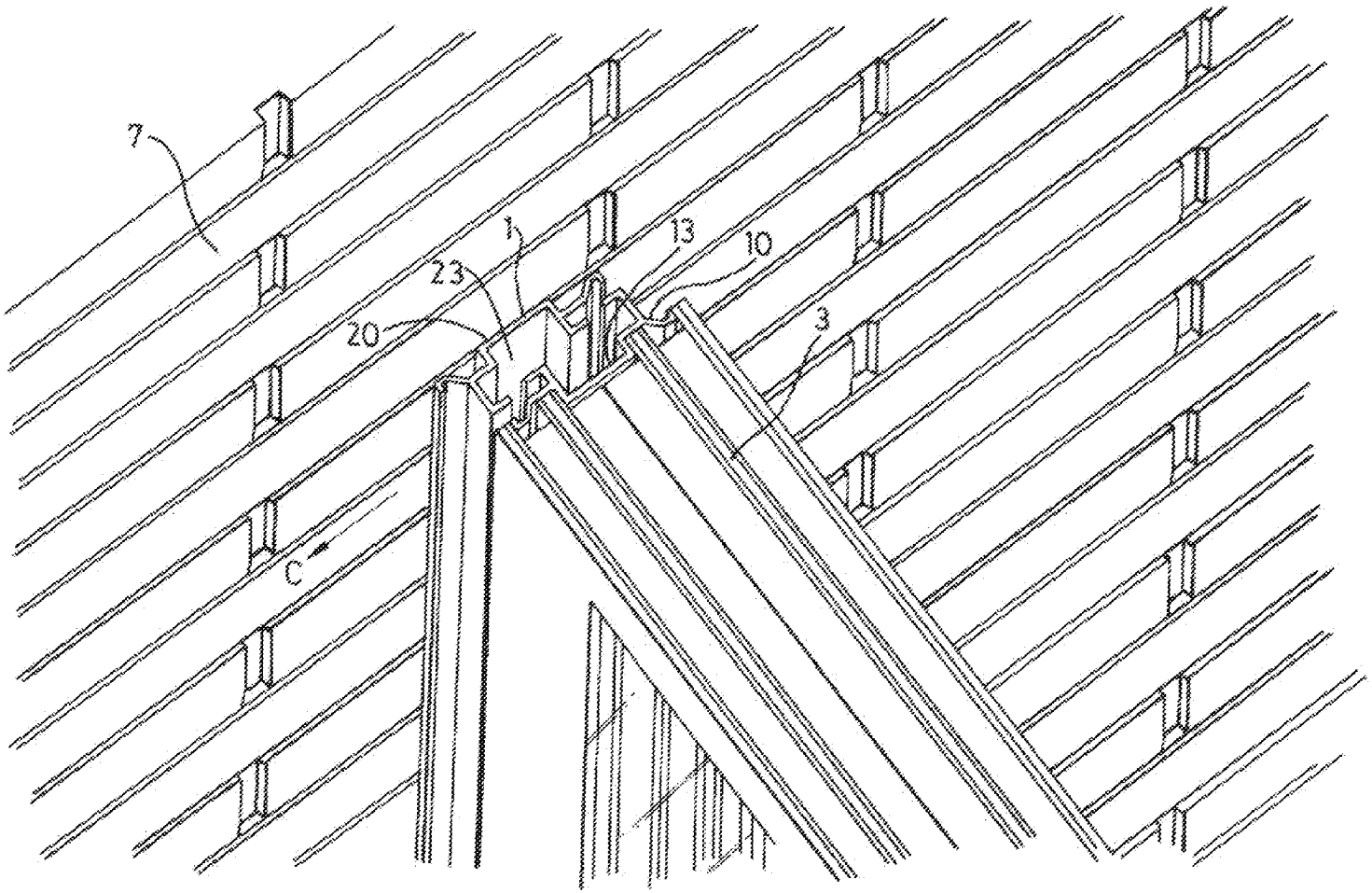
FIG. 2 is a perspective view showing a panel assembly being installed against a wall.

FIGS. 2 to 8 best illustrate the installation of a panel assembly 2. FIG. 2 illustrates the same connector assembly as FIG. 1 but shows it being located to connect a panel 3 to a building structure (wall) 7. The second connector member 20 is mounted to a wall 7 by its attachment portion 23 and the first connector member 10 is mounted to the panel 3 by its attachment portion 13. The panel 3 is located adjacent to the wall 7 such that the legs 11, 12, 21, 22 which provide the engagement means of the connector members 10, 20 are aligned with one another. The panel 3 is then slid into place by being moved in a second facing direction (illustrated by arrow C) to locate the connector members in the connecting configuration.

Figure 3:
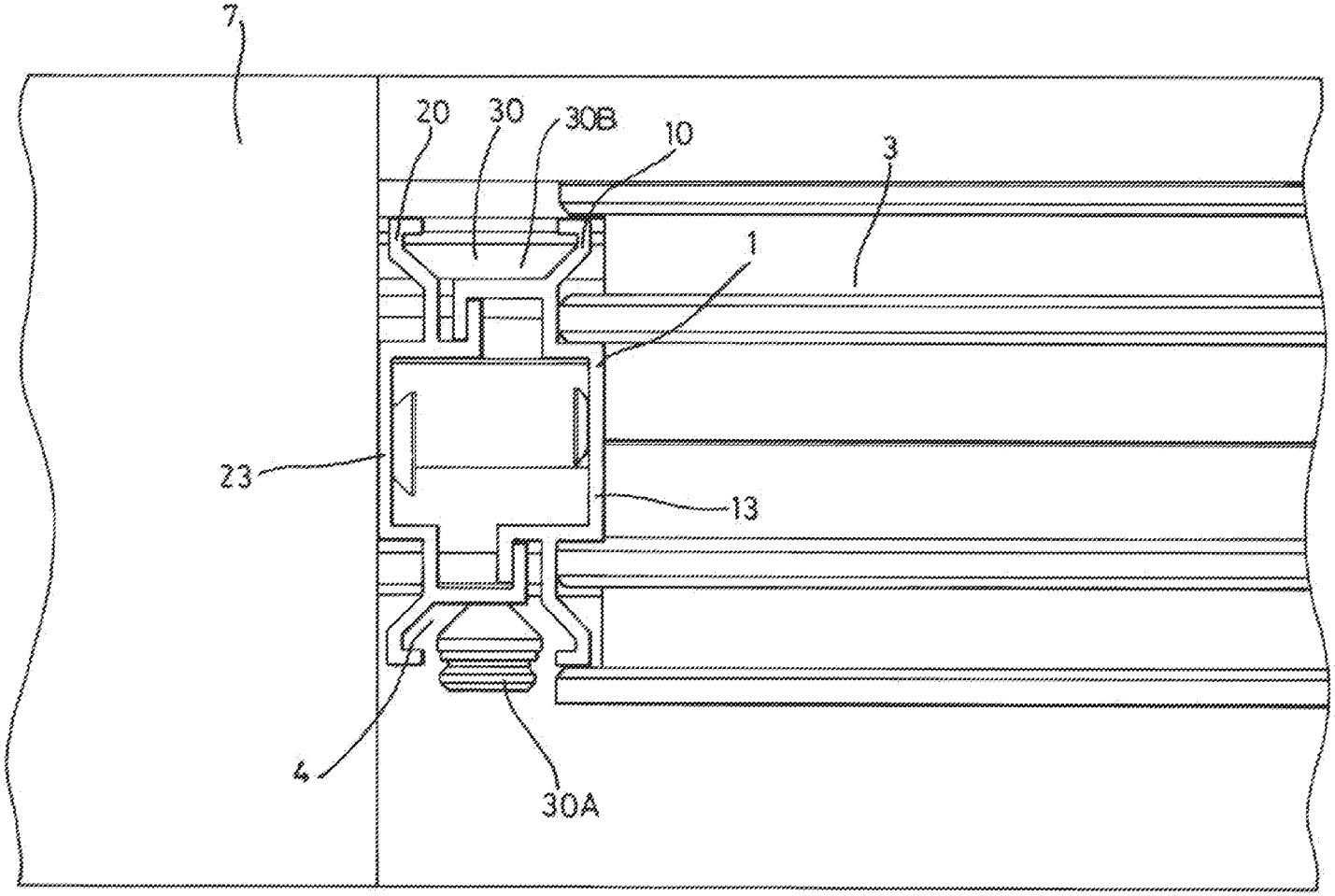
FIG. 3 is a plan view showing a connector assembly connecting a panel to a wall.

FIG. 3 shows the first and second connector members 10, 20 in the connecting configuration. Once the connector members are in this configuration the securement members 30 are located within the rebated channels 4. FIG. 3 illustrates one securement member 30 in a second orientation (illustrated by 30B) in which it prevents relative movement of the connector members 10, 20. Another securement member (illustrated by 30A) is located within a channel 4 but is in a first orientation and has not yet been rotated to the second orientation in which it restricts relative movement of the connector members 10, 20.

Figure 4:
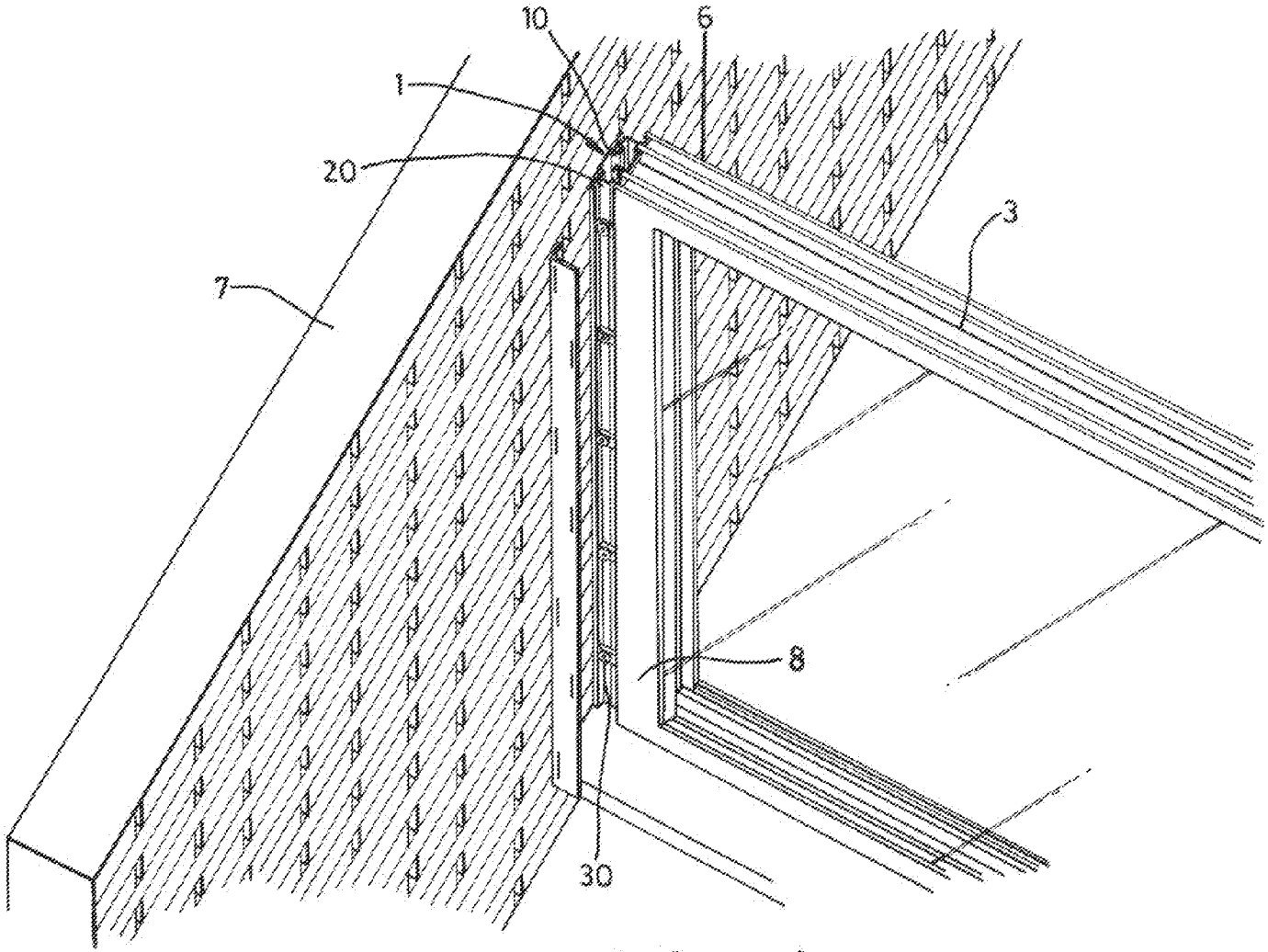
FIG. 4 is a perspective view showing a connector assembly connecting a panel to a wall.

FIG. 4 illustrates a panel mounted to a wall 7 by the connector assembly 1 and shows that five securement members 30 are located along the extent of the connector members on a second (outer) facing side 8 of the building structure. A similar number of connectors (not shown) are located in a similarly spaced manner on the first (inner) facing side 6 of the building structure.

Figure 5:
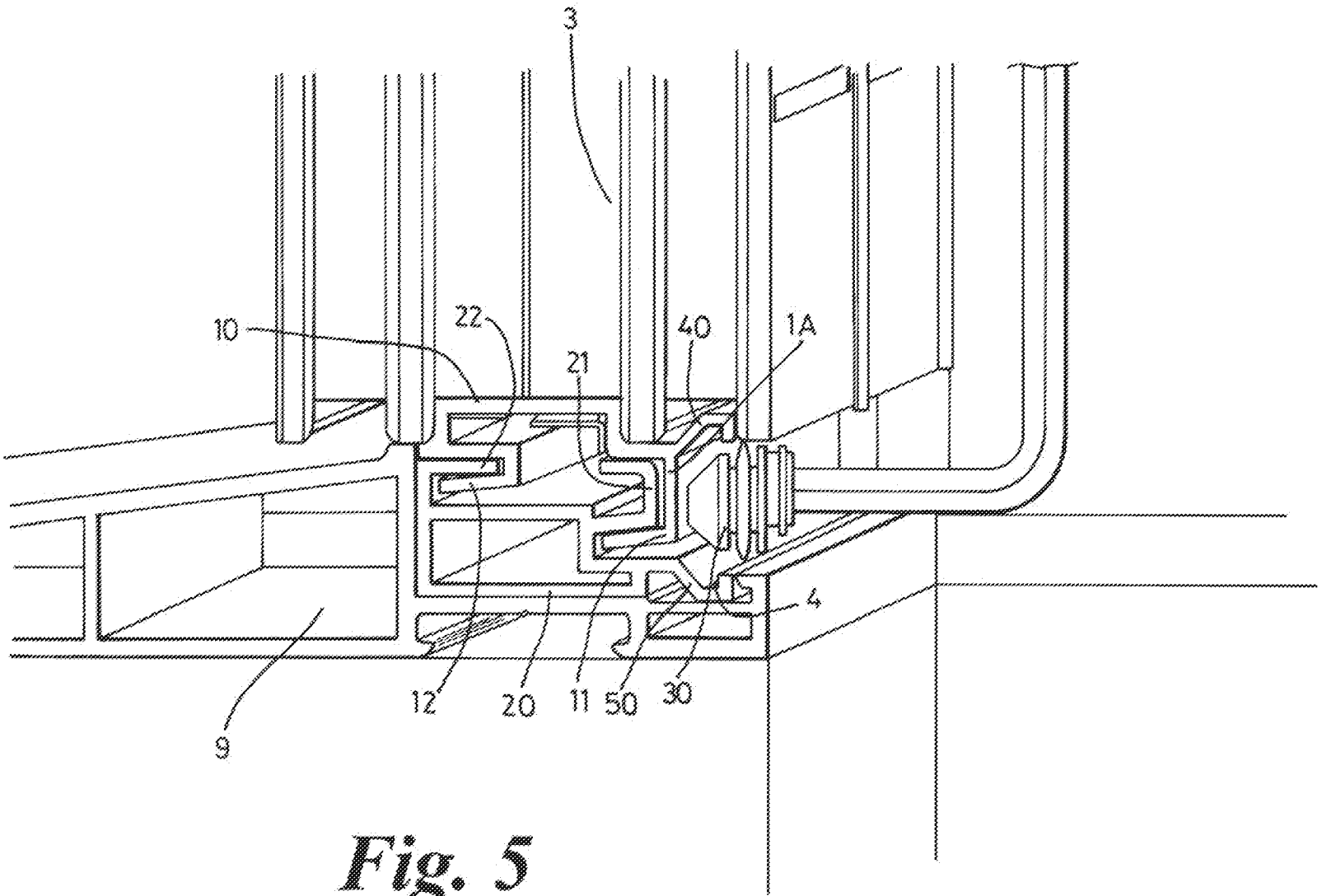
FIG. 5 is a perspective view showing an alternative embodiment of a connector assembly connecting a panel to a sill.

As best illustrated by FIG. 5 the panel assembly 2 comprises a further connector member for forming part of a connector assembly 1A for connecting a panel 3 to another building element (sill) 9. The connector assembly 1A is substantially the same as that of FIG. 1 and like parts are labelled accordingly. The distinction is that the assembly 1 comprises only one rebated channel 4.

The connector assembly 1A comprises first and second connector members 10, 20 each having a jaw portion 40, 50 as well as legs 10, 11, 21, 22 which provide engagement means of the assembly. The assembly further comprises securement members 30 (one shown) for locating in the channel 4 and securing the connector members 10, 20 in position relative to one another.

In use, the panel assembly 2 is moved into position such that connector members 10, 20 of connector assemblies 1, 1A are bought into a connecting configuration simultaneously.

Figure 6:
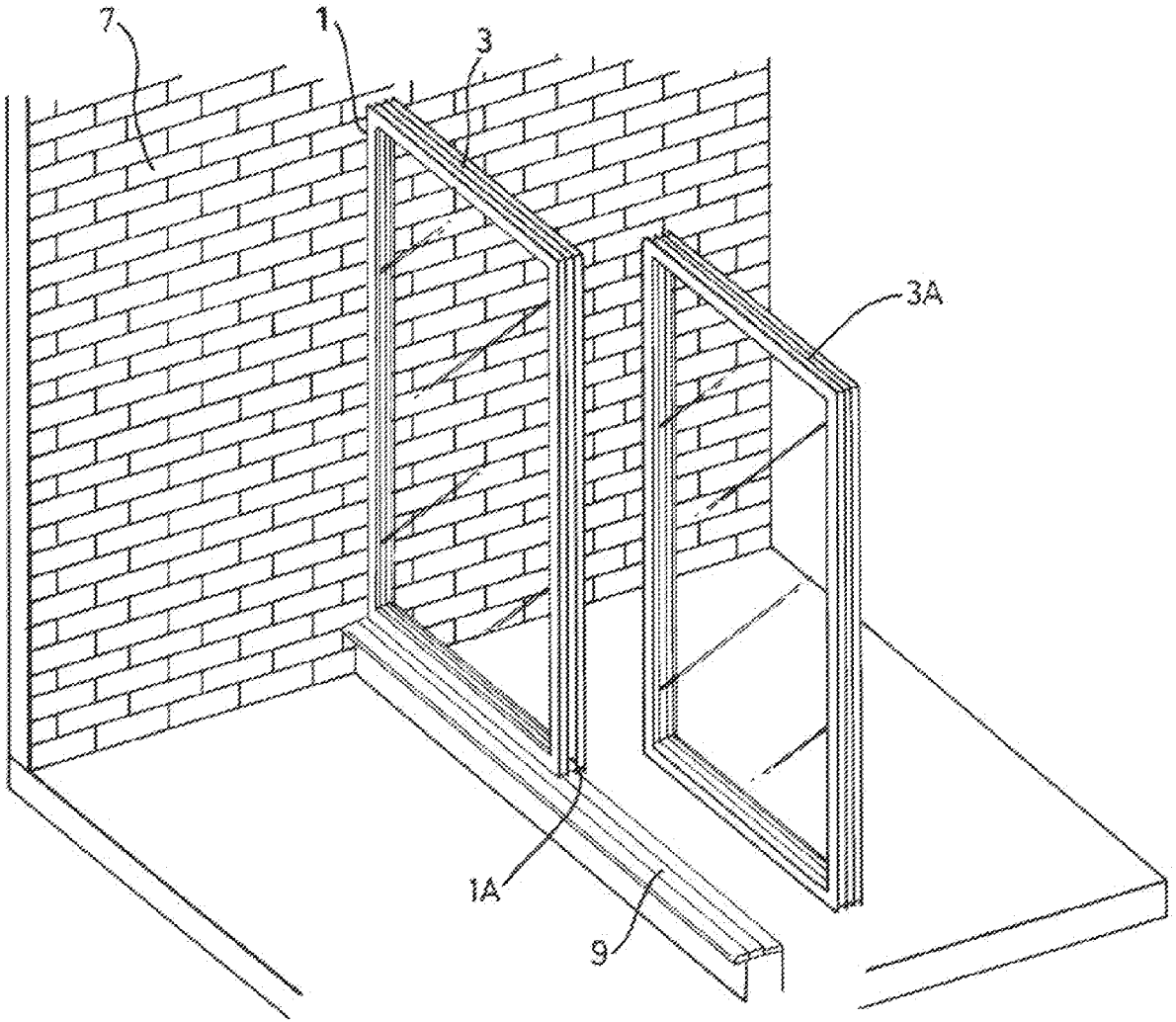
FIG. 6 is a perspective view showing the position of a panel assembly shortly before assembly into a building structure.

FIG. 6 illustrates a panel 3 connected to a wall 7 by a first connector assembly 1 and to another building element (sill) 9 by a second connector assembly 1A. A further panel 3A is located ready to be moved into position adjacent to the installed panel 3.

Figure 7:
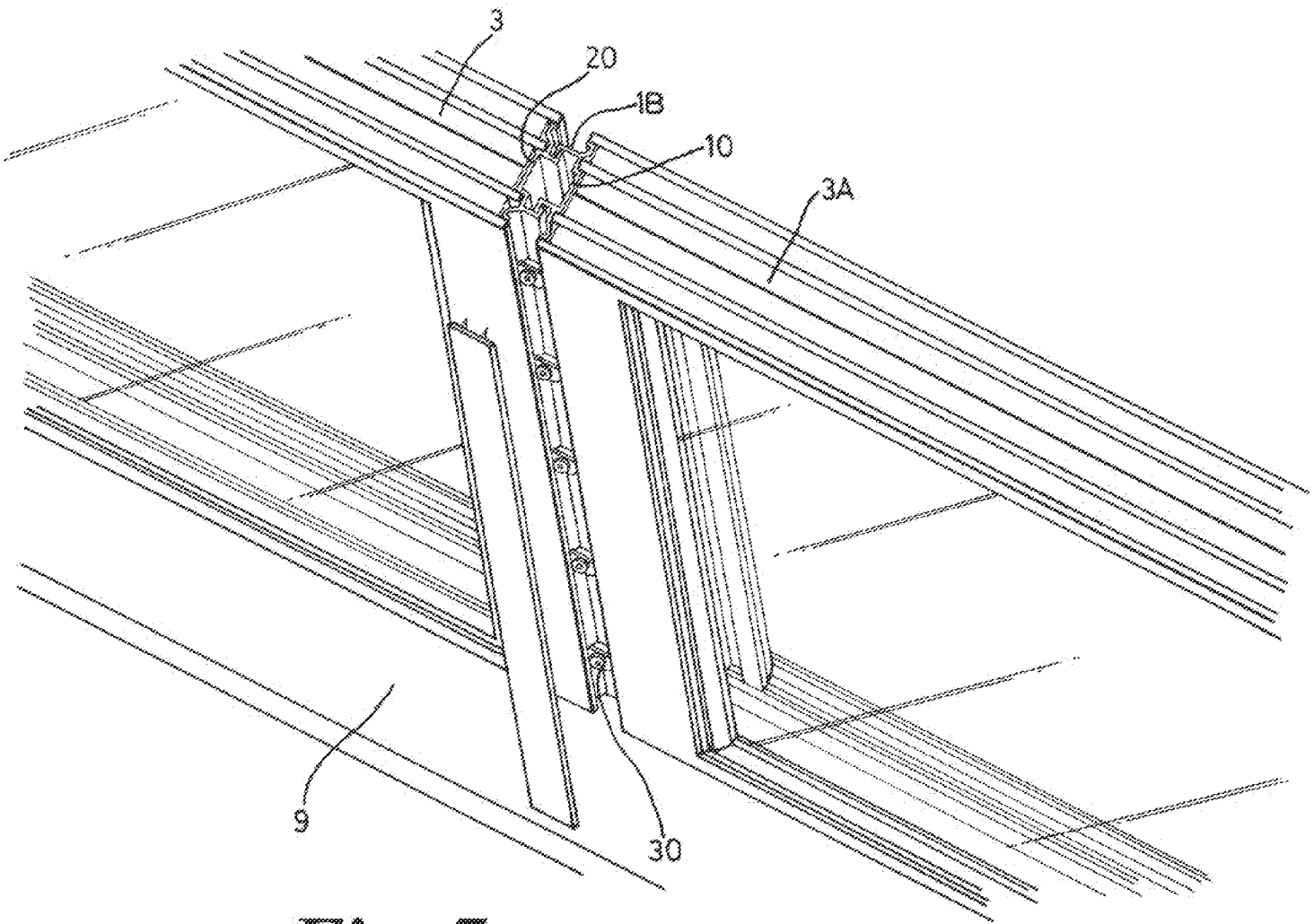
FIG. 7 is a perspective view showing a connector assembly connecting two panels.

FIG. 7 shows the further panel 3A installed in place and connected to the panel 3 which had already been installed as illustrated by FIG. 6. The connector assembly 1B connecting these panels 3, 3A to one another corresponds to the connector assembly 1 illustrated in FIG. 1.

It will thus be appreciated that the panel assembly 2 comprises a first connector member 10 extending along an upwardly extending edge of the panel 3 for forming part of a connecting assembly 1, a further first connector member 10 extending along a lower edge of the panel 3 for forming part of a connecting assembly 1A and a second connector member 20 extending along an upwardly extending edge of the panel 3 for forming part of a connecting assembly 1B.

Figure 8:
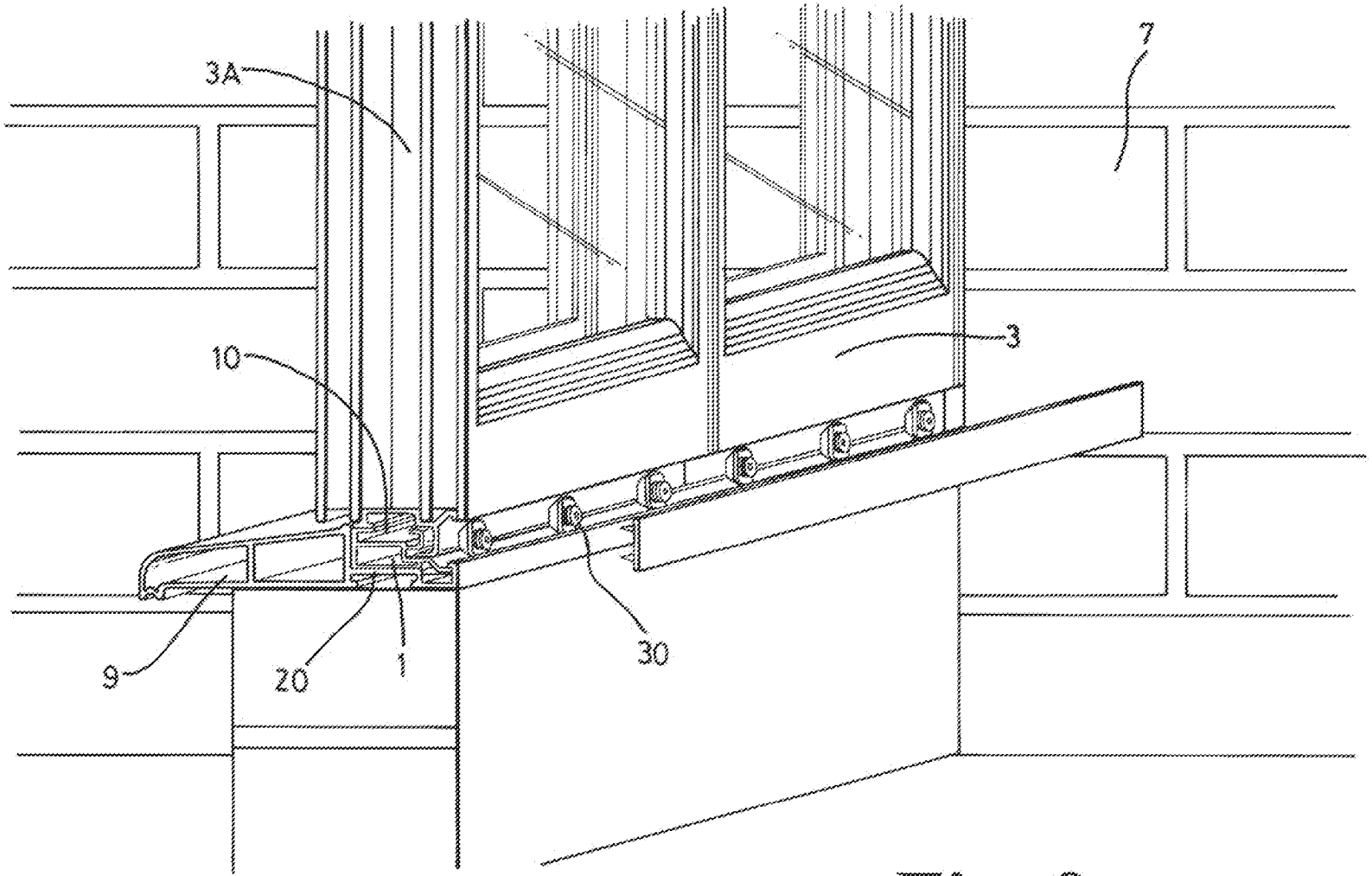
FIG. 8 is a perspective view showing part of a building structure.

As illustrated by FIG. 8 the further panel 3A is also connected to the sill 9 by a connector assembly 1 which is the same as that illustrated by FIG. 5. FIG. 8 also illustrates that this connector assembly 1 extends substantially horizontally and that it comprises a number of securement members 30 at spaced apart intervals.

Once assembled a building structure of the type shown by FIG. 8 may be disassembled by rotating the securement members to the first orientation, removing them from the jaws formed by the connector members and sliding the connector members apart.

Figure 9:
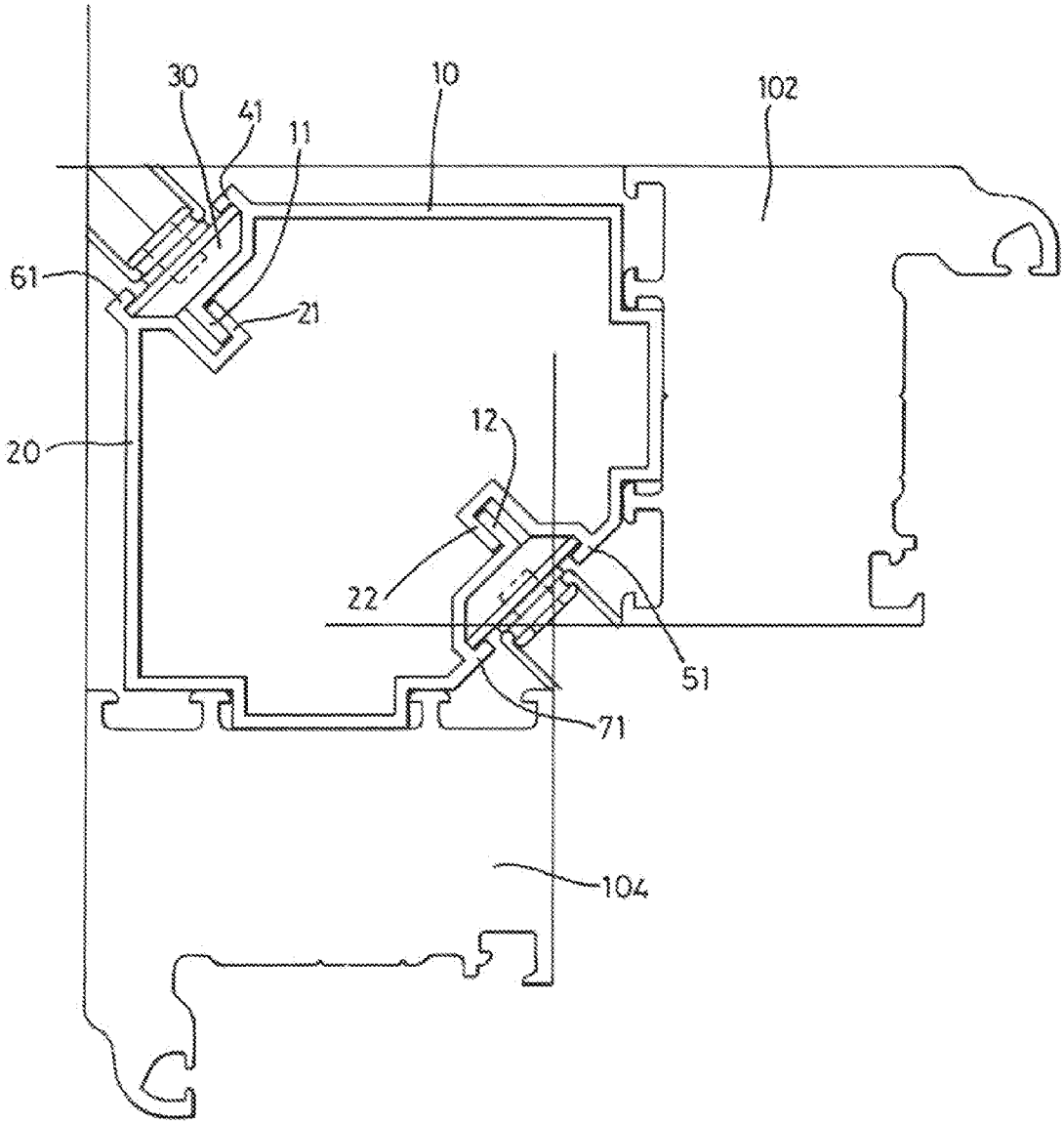
FIG. 9 is a plan view showing an alternative embodiment of a connector assembly connecting panels.

FIG. 9 illustrates an alternative embodiment of a connector assembly 1. The connector assembly operates along the same principles as that of FIG. 1, but is distinct in that it is arranged to provide a connection between building elements 102, 104 which form a corner of a structure and thus extend substantially perpendicularly to one another. The components of the assembly 1 are however substantially identical and like parts are labelled accordingly.

The assembly comprises first and second connector members 10, 20 each having a jaw portion 40, 50, 60, 70 as well as legs 10, 11, 21, 22 which provide engagement means of the assembly. The apparatus further comprises securement members 30 for locating in the rebated channels (shown occupied by securement members) formed by the jaws and securing the connector members in position relative to one another.

Figure 10:
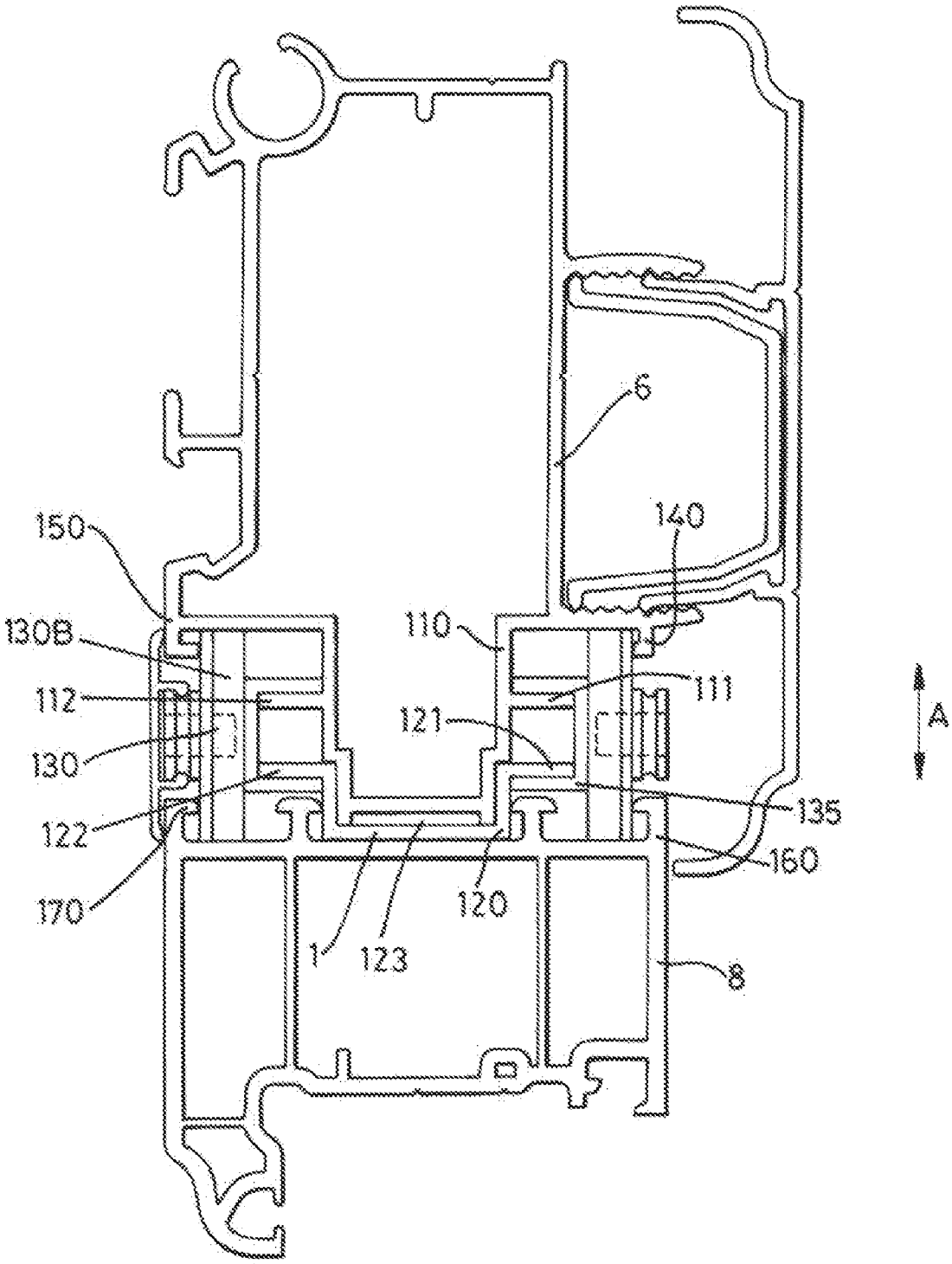
FIG. 10 is a plan view showing an alternative embodiment of a connector assembly connecting panels.
Figure 11:
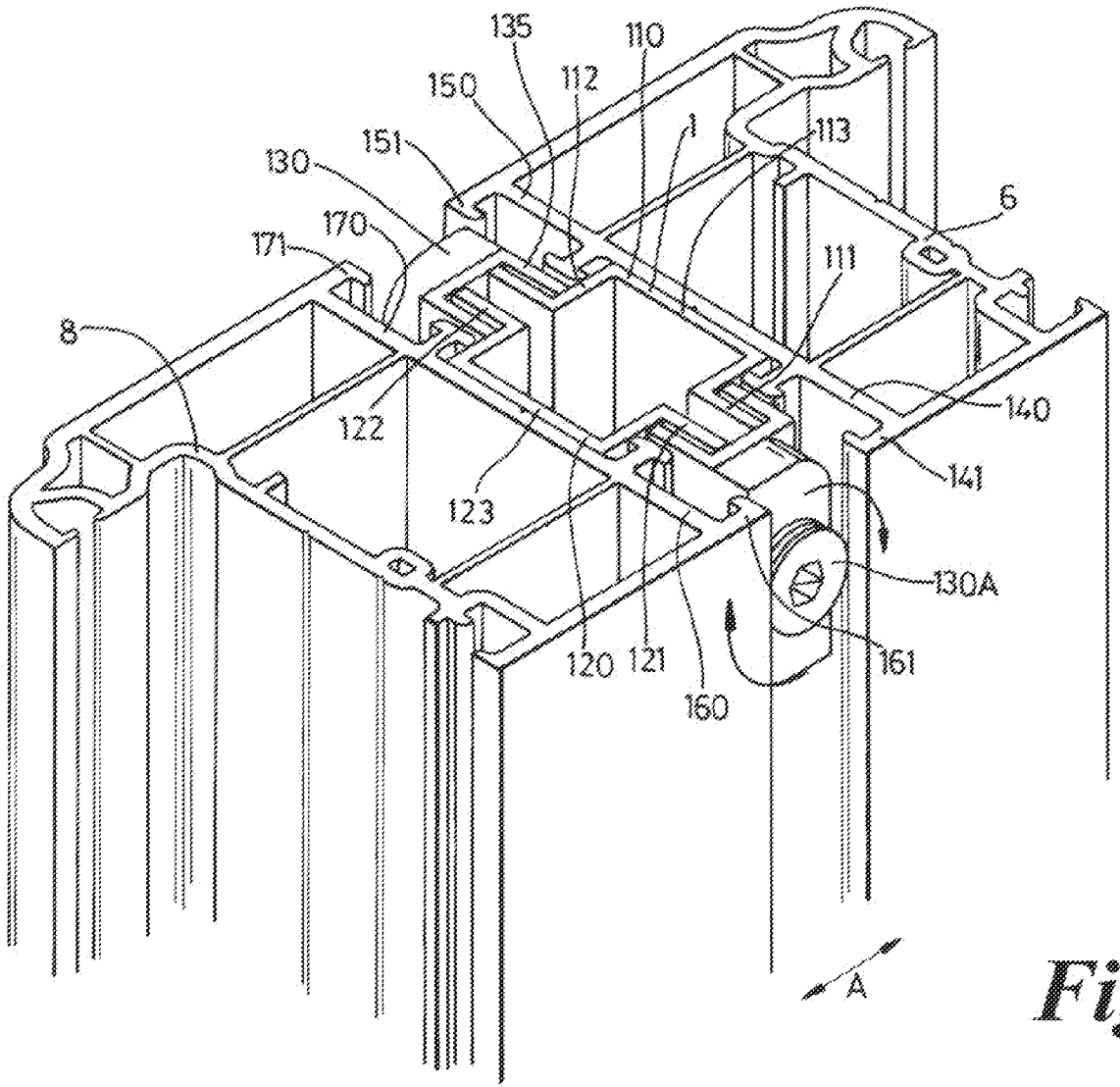
FIG. 11 is a perspective view showing an alternative embodiment of a connector assembly connecting panels.

FIGS. 10 & 11 illustrate further alternative embodiments of connector assemblies 1. These assemblies 1 are substantially identical to one another and like parts are labelled accordingly. They do though differ from the assemblies 1 of the embodiments of FIGS. 1, 5 and 9 in that part of the engagement means for restricting movement of the first connector members 110 in a first direction (illustrated by arrow A) relative to the second connector members 120 is provided as part of the securement members 130.

In the embodiment of FIG. 10 the first connector means 110 is integrally formed with a first body 6 and a second connector means comprises a member 120 which is mounted to a second body 8 by an attachment portion 123. The embodiment of FIG. 11 differs in that the first connector means 110 comprises a member which is separate from the first body 6 and mounted thereto by an attachment portion 113.

In each embodiment the connector means comprise legs 111, 112, 121, 122 arranged to be engaged by sleeves 135 forming part of securement members 130. In use, the sleeves 135 locate over the legs 111, 112, 121, 122 to hold the connector members 110, 120 in a connecting configuration by restricting separation in a direction (illustrated by arrow A) transverse to a facing direction. The legs 111, 112, 121, 122 thus comprise engagement means of the connector means and the sleeves 135 comprises further engagement means of the connector assembly 1.

The first body 6 comprises jaw portions 140, 150 and the second body 8 comprises jaw portions 160, 170 with the jaw portions co-operating, in use, to define rebated channels. Each jaw portion includes an outer lip 141, 151, 161, 171.

The securement member 130 comprises engagement, portions 132 pivotally mounted to sleeves 135. In use, the engagement portions can be rotated between a first orientation (illustrated by 130A in FIG. 11) and a second orientation (illustrated by 130B in FIG. 10). In the first orientation the engagement portion 132 can be located between the outer lips 141, 161 for 151, 171 of a jaw and in the second it can not pass between the outer lips and is thus retained within the channel. The securement members 30 thus restrict relative movement of the first and second connector means in first and second facing directions (illustrated by arrows B and C) when in the second orientation with said connector means in the connecting configuration.

Figure 12:
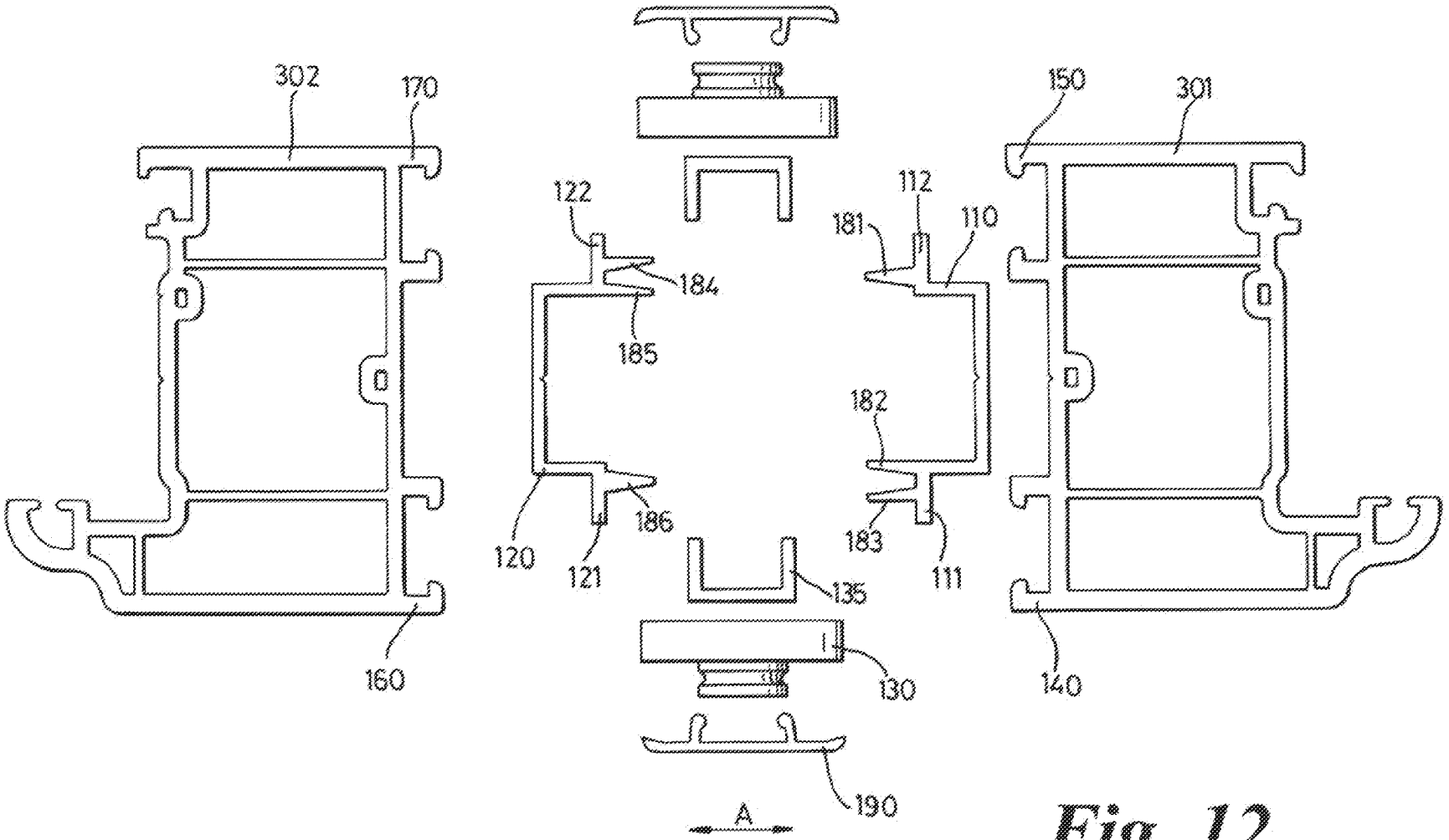
FIG. 12 is a plan view showing the components of an alternative embodiment of a connector assembly.

FIG. 12 illustrates a further alternative embodiment of a connector assembly. The assembly corresponds generally to that of FIG. 11 and like parts are labelled accordingly. The distinction is that first and second connector means comprise members 110, 120 which each comprise locating means for holding the connector members 110, 120 in position relative to one another whilst a sleeve (or clasp) 135 and securement member 130 are installed. Additionally, the sleeve 135 is a separate component from the securement member 130.

The first and second connector members 110, 120 each comprise aluminium couplers which are mechanically fixed to first and second PVC bodies (window frames) 301, 302 respectively in factory controlled conditions.

The locating means comprise legs 181, 182, 183 of the first connector member 110 and legs 184, 185, 186 of the second connector member 120 which are arranged to engage one another.

In use, the bodies can be moved together in a direction (illustrated by arrow A) transverse to a facing direction. The connector members are notched together such that leg 181 fits in a slot between legs 184 and 185 and leg 186 fits in a slot between legs 182 and 183. Thus, the locating means also serves as engagement means which restrict relative movement of the bodies 301, 302 in a facing direction.

Once the connector members 110, 120 are in a connecting configuration sleeves 135 are slid over legs 111, 112, 122, 122 (which extend transverse to legs 181, 182, 183, 184, 185, 186) to hold the connector members 110, 120 in place. The sleeves 135 prevent the connector members 110,120 from being moved apart in the direction of arrows A.

The sleeves 135 are then held in place by securement members 130 which are located into rebated channels defined by jaw portions 140, 150, 160, 170 of the first and second body 301, 302.

The securement members 130 are located in the channels and turned through 90 degrees. The geometry of the bodies 301, 302 and connector members 110, 120 provide a tight friction fit for the securement members 130 allowing them to bind the bodies 301, 302 together.

Once the bodies are fixed to one another a trim 190 is located over the open channel to cover the securement members 130.

Figure 13:
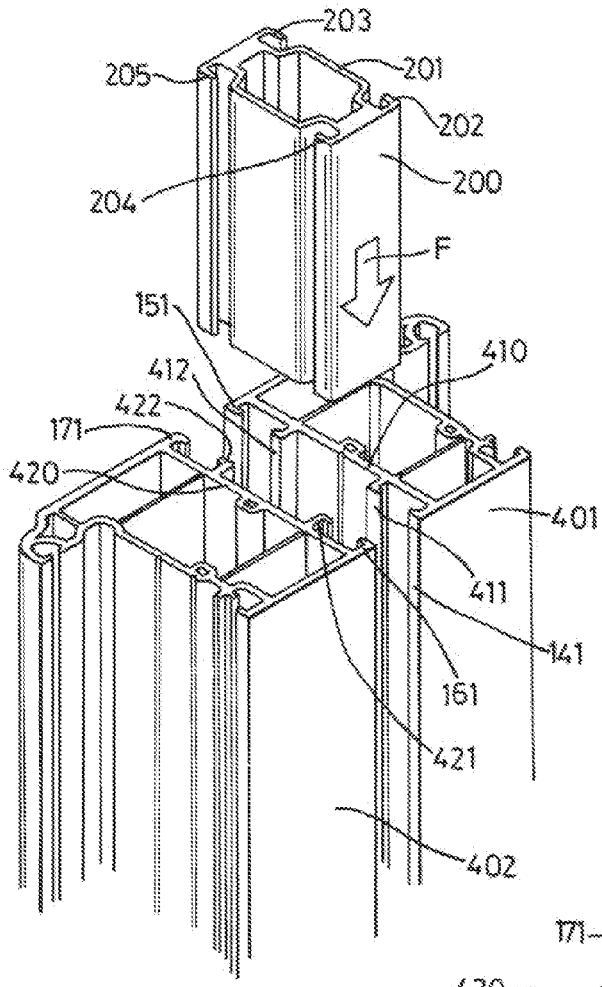
FIG. 13 is a perspective view showing an alternative embodiment of a connector assembly.
Figure 14:
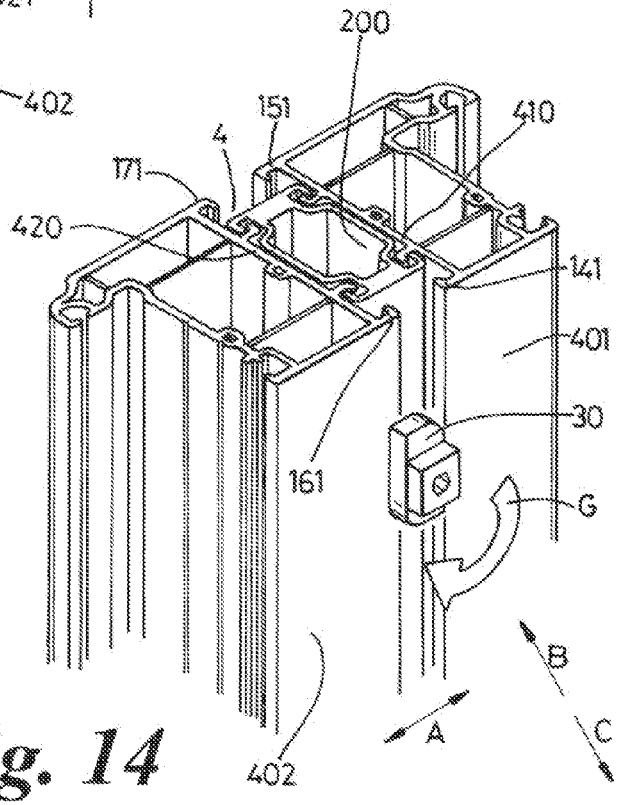
FIG. 14 is a perspective view showing the connector assembly of FIG. 13 connecting panels.

FIGS. 13 and 14 illustrate an alternative embodiment of a connector assembly. The connector assembly 1 is distinct from that of the other embodiments in that the first and second connector means 410, 420 do not directly engage one another. Instead, the connector assembly further comprises a link member 200 comprising an in-line connector. Otherwise, the connector assembly 1 is substantially the same as that of the other embodiments and like parts are labelled accordingly.

The connector means 410, 420 form integral parts of bodies (window frames) 401, 402 respectively. The first connector means comprises first and second engagement legs 411, 412 and the second connector means comprises first and second engagement legs 421, 422.

The link member 200 comprises a metal member which provides structural strength to a building structure in use. Thus, the window frames 401, 402 are able to comprise PVC sections which are not reinforced. This may make the frames simpler and more economic to produce.

The link member 200 comprises a body 201. Extending from the body 201 are a pair of first legs 202, 203 for engaging with the first connector means and a pair of second legs 204, 205 for engaging with the second connector means.

The first legs 202, 203 cooperate with the body 201 to define channels into which the legs 411, 412 of the first connector means can locate. Similarly, the second legs 204, 205 cooperate with the body 201 to define channels into which the legs 421, 422 of the first connector means can locate.

In use, the bodies 401, 402 can be located with the first and second connector means 410, 420 adjacent one another. The link member 200 can then be slid into engagement with the connector means as shown by arrow F of FIG. 13.

Once the link member 200 engages the connector means 410, 420 the legs of the connector means are held within the channels formed by the link member 200 such that the connector means are held in a connecting configuration as shown by FIG. 14. In this configuration the legs 411, 412, 421, 422 are able to move within the channels such that the connector means and thus the bodies 401, 402 can move to a limited extent relative to one another and relative to the link member 200 in the direction of arrows A, B and C.

This loose fit may allow for the link member to be slid easily into place and may allow for greater manufacturing tolerances for the components.

The bodies 401, 402 each comprise outer lips 141, 151, 161, 171 which form jaws defining channels 4 for receiving securement members 30.

In use, securement members 30 can be located into a channel formed by a jaw and rotated through 90 degrees as illustrated by arrow G of FIG. 14. The securement member 30 is a tight fit within the jaw and bears against the link member 200 such that it prevents relative movement of the bodies 401, 402 in the direction illustrated by arrows B and C. Rotating the securement member 30 within the jaw also causes the bodies 401, 402 to be forced apart in the direction illustrated by arrows A such that they adopt the extreme position the link member 200 permits. Thus, movement in the direction of arrows A is prevented.

Accordingly, the securement member is held in place within the jaw and the bodies 401, 402 may be locked in position relative to one another.

Figure 15:
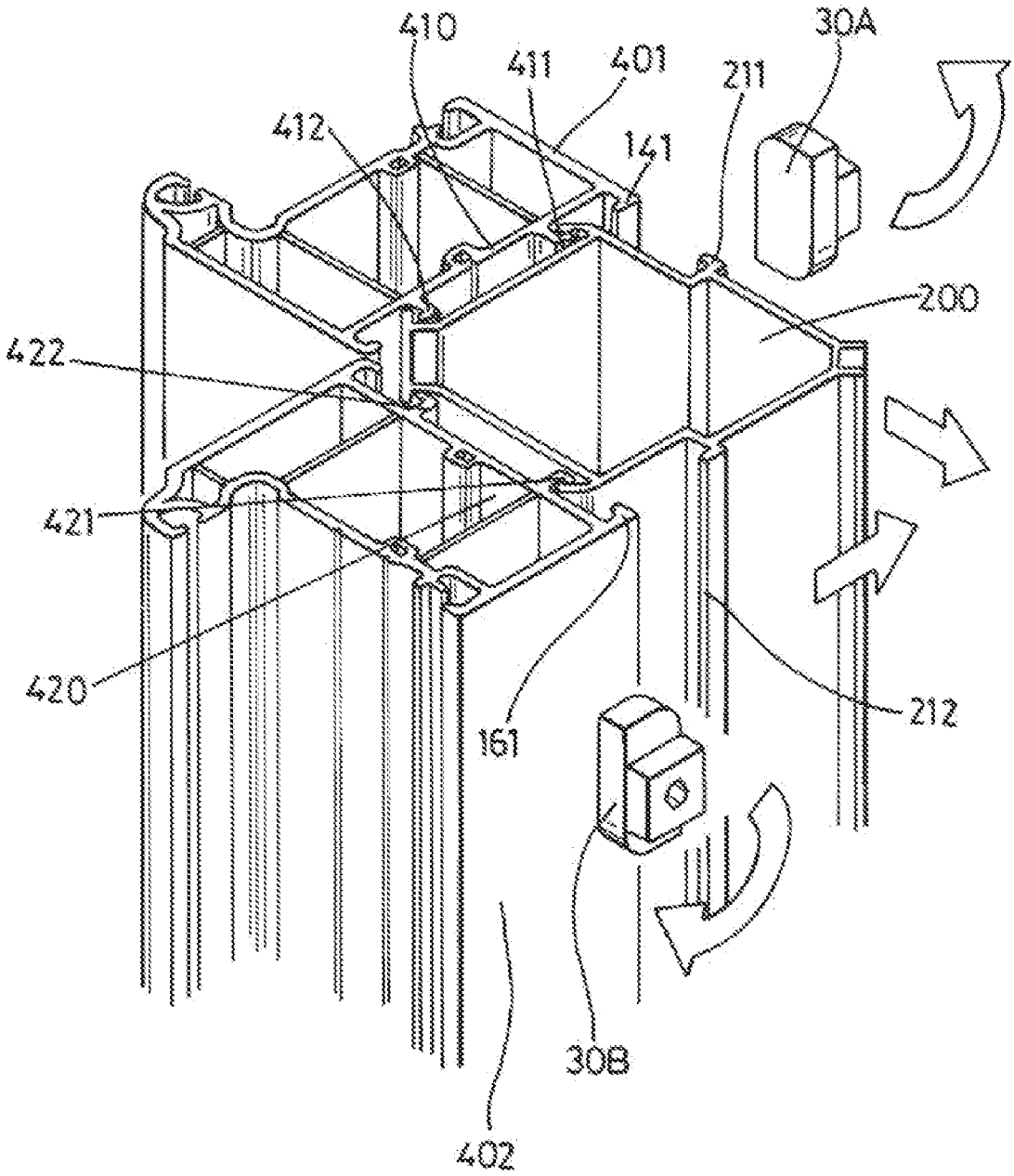
FIG. 15 is a perspective view showing an alternative embodiment of a connector assembly connecting panels.

FIG. 15 illustrates an alternative embodiment of a connector assembly. The principle is substantially the same as that of FIGS. 13 and 14 and like parts are labelled accordingly. The distinction is that a link member joins two bodies 401, 402 which meet at a corner. In this case parts of the link member 200 form parts of jaws for receiving securement members 30. Otherwise though the assembly generally corresponds to that of FIGS. 13 and 14 and like parts are labelled accordingly.

The link member 200 comprises a first lip 211 which cooperates with a lip 141 of a body 401 to define a jaw for receiving a securement member 30A. The link member 200 further comprises a second lip 212 which cooperates with a lip 161 of a body 402 to define a jaw for receiving a securement member 30B.

As with the embodiment of FIGS. 13 and 14, in use, the link member 200 is slid into place such that legs 411, 412, 421, 422 of the connector means 410, 420 locate loosely in channels formed by the link member 200. Securement members 30A, 30B are then introduced into the channels 4 defined by jaws formed by the lips of the bodies 401, 402 and link member 200. The securement members are then rotated to take up the slack in the system such that the bodies 401, 402 are held rigidly in place.

It will be appreciated that preferred embodiments of the present invention may allow the expedient assembly of a building structure.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A panel assembly for forming a building structure, said panel assembly comprising a panel and a first connector means for forming part of a connector assembly for connecting the panel to a body, said connector assembly comprising said first connector means, a second connector means, one or more securement members and a link member, wherein the first and second connector means are, or can be, connected to the panel and body respectively and wherein the first connector means is arranged such that, in use, it can be positioned in a connecting configuration in which it engages the link member which in turn engages the second connector means, such that said link member defines a recessed wall of at least one channel of the panel assembly which channel is exposed to a facing side of the panel so as to receive an engagement part of one or more securement members therein; wherein the facing side is a side of the panel orientated to face inwardly, or outwardly of a building structure in use, and wherein each securement member is arranged such that, in use, it can be arranged in the at least one channel in a first orientation in which it does not restrict relative movement of the link member and the respective connector means it is engaged with, and a second orientation in which it restricts relative movement of the link member and the respective connector means it is engaged with.

2. An assembly according to claim 1, wherein the link member comprises an in-line connector.

3. An assembly accordingly to claim 1, wherein the link member is arranged to provide structural strength to a building structure which incorporates it.

4. An assembly according to claim 1, wherein the panel assembly is arranged such that it can be positioned adjacent a body and held in position relative to the body by bringing a link member into engagement with the first connector means of the panel and a second connector means of the body.

5. An assembly according to claim 4, wherein the link member can be slid into position.

6. An assembly according to claim 4, wherein the panel assembly is arranged such that, in use, once the panel is held in position relative to the body by the link member one or more securement members can be located to fix the relative positions of the panel and body.

7. An assembly according to claim 1, wherein in use, the securement member is held in its second orientation within the channel by means of an interference fit.

8. An assembly according to any preceding claim, wherein the panel assembly comprises connector means of two or more connector assemblies.

9. An assembly according to claim 8 wherein a first connector means is located on an upwardly extending, in use, edge of the panel and a first connector means is located on a lower, in use, edge of the panel.

10. An assembly according to claim 8, wherein the panel assembly comprises a first connector means located on a first upwardly extending, in use, edge of the panel a second connector means located on a second, opposed, upwardly extending, in use, edge of the panel.

11. An assembly according to claim 1, wherein when installed in the channel, the securement member or members restrict movement of the panel relative to a body, in a facing direction which comprises the direction in which the opening of the channel faces.

12. An assembly according to claim 11, wherein when installed, the securement member or members restrict movement of the panel in a facing direction which comprises the direction in which the opening of the channel faces.

13. An assembly according to claim 12, wherein when installed, the securement member or members restrict movement of the panel in a facing direction substantially opposed to said facing direction in which the opening of the channel faces.

14. An assembly according to claim 12, wherein when installed, the securement member or members restrict movement of the panel in a direction transverse to a facing direction.

15. An assembly according to claim 1, wherein the panel comprises a window frame.

16. An assembly according to claim 1, wherein the panel assembly is arranged to be connected to a body which comprises a building element or structure.

17. A building structure comprising one or more panel assemblies according to claim 1.

18. A building structure according to claim 17, wherein the building structure is formed from a kit for forming a building structure, said kit comprising one or more bodies comprising building elements, including one or more panels, and one or more connector assemblies, wherein one or more connector assemblies of the kit comprises first and second connector means, one or more securement members and one or more link members, wherein the first and second connector means are or can be connected to bodies which are to be connected and can be positioned in a connecting configuration in which the first connector means engages the link member which in turn engages the second connector means, such that said link member defines a recessed wall of at least one channel which channel is exposed to having a facing side of the one or more panels so as to receive an engagement part of one or more securement members therein; wherein the facing side is a side of the panel oriented to face inwardly, or outwardly of a building structure in use; and wherein each securement member is arranged such that, is use, it can be arranged in the at least one channel in a first orientation in which it does not restrict relative movement of the link member and the respective connector means it is engaged with, and a second orientation in which it restricts relative movement of the link member and the respective connector means it is engaged with.

19. A kit for forming a building structure, said kit comprising one or more bodies comprising building elements, including one or more panels, and one or more connector assemblies, wherein one or more connector assemblies of the kit comprises first and second connector means, one or more securement members and one or more link members, wherein the first and second connector means are or can be connected to bodies which are to be connected and can be positioned in a connecting configuration in which the first connector means engages the link member which in turn engages the second connector means, such that said link member defines a recessed wall of at least one channel which channel is exposed to a facing side of the one or more panels so as to receive an engagement part of one or more securement members therein; wherein the facing side is a side of the panel orientated to face inwardly, or outwardly of a building structure in use and wherein each securement member is arranged such that, is use, it can be arranged in the at least one channel in a first orientation in which it does not restrict relative movement of the link member and the respective connector means it is engaged with, and a second orientation in which it restricts relative movement of the link member and the respective connector means it is engaged with.

20. A kit for forming a building structure, said kit comprising one or more bodies comprising building elements, including one or more panels, and one or more connector assemblies, wherein one or more connector assemblies of the kit comprises first and second connector means, one or more securement members and one or more link members, wherein the first and second connector means are or can be connected to bodies which are to be connected and can be positioned in a connecting configuration in which the first connector means engages the link member which in turn engages the second connector means, such that said link member defines a recessed wall of at least one channel which channel is exposed to having a facing side of the one or more panels so as to receive an engagement part of one or more securement members therein; wherein the facing side is a side of the panel oriented to face inwardly, or outwardly of a building structure in use; and wherein each securement member is arranged such that, is use, it can be arranged in the at least one channel in a first orientation in which it does not restrict relative movement of the link member and the respective connector means it is engaged with, and a second orientation in which it restricts relative movement of the link member and the respective connector means it is engaged with, wherein the kit comprises one or more panel assemblies according to claim 1.

21. A method of assembling a building structure, wherein the method comprises locating a panel assembly comprising a panel and a first connector means adjacent a building element or structure comprising a second connector means and locating the connector means in a connecting configuration using a link member, such that said link member defines a recessed wall of at least one channel of the panel assembly which channel is exposed to a facing side of the panel so as to receive an engagement part of one or more securement members therein, wherein the facing side is a side of the panel orientated to face inwardly, or outwardly of a building structure in use, and locating one or more securement members such that they retain the panel in position relative to the building element or structure, wherein said securement member or members, or a part thereof, are located into the at least one exposed channel having an opening on a facing side of the panel; wherein the method further comprises locating one or more securement members into position from the inside and/or outside of a building structure, or partial structure, with the connector means located in a connecting configuration; and wherein following insertion of the engagement portion of a securement the method comprises rotating the securement member relative to the connector means to orientate the securement member such that it can not be withdrawn from the channel.

22. A method according to claim 21, wherein said method comprises locating a panel such that the connector means, and a link member, hold the panel in position relative to a building element or structure such that it has some freedom to move until said securement member or members are installed and once said securement member or members are installed the freedom of the panel to move is substantially removed.

23. A method of assembling a building structure, wherein the method comprises locating a panel assembly comprising a panel and a first connector means adjacent a building element or structure comprising a second connector means and locating the connector means in a connecting configuration using a link member, such that said link member defines a recessed wall of at least one channel of the panel assembly which channel is exposed to a facing side of the panel so as to receive an engagement part of one or more securement members therein, wherein the facing side is a side of the panel oriented to face inwardly, or outwardly of a building structure in use, and locating one or more securement members such that they retain the panel in position relative to the building element or structure, wherein said securement member or members, or a part thereof, are located into the at least one exposed channel having an opening on a facing side of the panel; wherein the method further comprises locating one or more securement members into position from the inside and/or outside of a building structure, or partial structure, with the connector means located in a connecting configuration; and wherein following insertion of the engagement portion of a securement the method comprises rotating the securement member relative to the connector means to orient the securement member such that it can not be withdrawn from the channel, wherein the method employs a panel assembly according to claim 1.

24. A method according to claim 21, wherein the method comprises locating a panel assembly comprising a substantially horizontally extending connector means and a substantially vertically extending connector means relative to a building structure or partial structure comprising a substantially horizontally extending connector means and a substantially vertically extending connector means such that the respective connector means are located in a connecting configuration substantially simultaneously.

* * * * *

UNITED STATES PATENT AND TRADEMARK OFFICE

CERTIFICATE OF CORRECTION

PATENT NO. : 8,061,103 B2
APPLICATION NO. : 11/913700
DATED : November 22, 2011
INVENTOR(S) : Barry Peter McMahon It is certified that error appears in the above-identified patent and that said Letters Patent is hereby corrected as shown below:

In claim 19, line 17, change “use and” to -- use; and --.

In claim 19, line 18, change “is” to -- in --.

Signed and Sealed this
Fourteenth Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,061,103 B2
APPLICATION NO. : 11/913700
DATED : November 22, 2011
INVENTOR(S) : Barry Peter McMahon It is certified that error appears in the above-identified patent and that said Letters Patent is hereby corrected as shown below:

Column 17, line 7 (claim 19, line 17) change "use and" to -- use; and --.

Column 17, line 8 (claim 19, line 18) change "is" to -- in --.

This certificate supersedes the Certificate of Correction issued February 14, 2012.

Signed and Sealed this
Twentieth Day of March, 2012

David J. Kappos

David J. Kappos
*Director of the United States Patent and Trademark Office*